US010570639B1

(12) United States Patent
Annas

(10) Patent No.: US 10,570,639 B1
(45) Date of Patent: Feb. 25, 2020

(54) SHAPE DISRUPTER FOR NET SUPPORT SYSTEM

(71) Applicant: SAAB BARRACUDA LLC, Lillington, NC (US)

(72) Inventor: David W. Annas, Lillington, NC (US)

(73) Assignee: SAAB BARRACUDA LLC, Lillington, NC (US)

( * ) Notice: Subject to any disclaimer, the term of this patent is extended or adjusted under 35 U.S.C. 154(b) by 0 days.

(21) Appl. No.: 16/255,402

(22) Filed: Jan. 23, 2019

(51) Int. Cl.
*E04H 15/60* (2006.01)
*F41H 3/02* (2006.01)
*E04H 15/54* (2006.01)

(52) U.S. Cl.
CPC ..... *E04H 15/60* (2013.01); *E04H 15/54* (2013.01); *F41H 3/02* (2013.01)

(58) Field of Classification Search
CPC ..... E04H 15/60; E04H 15/64; F41H 3/02
See application file for complete search history.

(56) References Cited

U.S. PATENT DOCUMENTS 3,374,798 A * 3/1968 Samuelson ..... A45B 23/00 135/33.7
3,425,428 A * 2/1969 Schwartz ..... E04H 15/60 135/114
3,866,619 A * 2/1975 Per Frisk ..... E04H 15/60 135/114
4,021,974 A 5/1977 Edwards
4,441,518 A * 4/1984 Hogan ..... E04H 15/28 135/147
5,477,876 A * 12/1995 Moss ..... E04H 15/26 135/100
5,593,239 A * 1/1997 Sallee ..... E04H 12/182 135/114
5,918,614 A * 7/1999 Lynch ..... E04H 15/18 135/114
6,523,558 B1 * 2/2003 Gillis ..... E04H 15/60 135/119

(Continued)

FOREIGN PATENT DOCUMENTS

AU 2013219223 A1 4/2014
DE 6922480 U 11/1970

(Continued)

OTHER PUBLICATIONS

RolaTube; ULCANS Ultra-Lightwieght Camouflage Netting System User Guide; Retrieved from: http://www.rolatube-expeditionary-systems.com/wp-content/uploads/2018/01/ULCANS-User-Guide-V6-US.pdf; 4 pages.

(Continued)

*Primary Examiner* — Noah Chandler Hawk
(74) *Attorney, Agent, or Firm* — Barnes & Thornburg LLP

(57) ABSTRACT

A shape disrupter for a net support system may have a conical body and an elliptical shape in plan view. The shape disrupter may have low thermal signature and low weight. The shape disrupter may be stackable. The shape disrupter may have a protrusion on the shape disrupter for fixing each of the shape disrupters in place during stacking. The shape disrupter may have cutouts or openings to reduce the weight and thermal signature of the shape disrupter. The shape disrupter of the present disclosure may cooperate with support poles or nets to provide a support system for large nets or screens.

14 Claims, 8 Drawing Sheets

(56) References Cited

U.S. PATENT DOCUMENTS

| | | | | |
|---|---|---|---|---|
| 7,140,375 | B2 * | 11/2006 | Norris | E04H 15/60 135/119 |
| 7,353,833 | B1 * | 4/2008 | Palmer | E04H 15/60 135/118 |
| 7,556,053 | B2 * | 7/2009 | Hansen | F41H 3/02 135/114 |
| 8,360,700 | B2 | 1/2013 | Wienke | |
| 2001/0022189 | A1 | 9/2001 | Hexels | |
| 2009/0084043 | A1 | 4/2009 | Tarbet et al. | |

FOREIGN PATENT DOCUMENTS

| | | | | |
|---|---|---|---|---|
| EP | 0199851 | A1 | 11/1986 | |
| EP | 1464914 | B1 | 2/2006 | |
| GB | 2167168 | A * | 5/1986 | F41H 3/00 |

OTHER PUBLICATIONS

Action Surplus; Camouflage Net Support System; Retrieved from: http://www.actionsurpluseugene.com/camouflage-net-support-system/; 3 pages.

PicClick.com; Military Camo Camouflage Net Support System Aluminum Antenna Mast Poles Used; Retrieved from: https://picclick.com/Military-Camo-Camouflage-Net-Support-System-Aluminum-Antenna-181367372114.html; 5 pages.

US Army Gear; US Military Camo Camouflage Net Support System 12 Poles Bag 18 Stakes Spreaders; Retrieved from: http://usarmygear.net/shop/gears/us-military-camo-camouflage-net-support-system-12-poles-bag-18-stakes-spreaders/, 3 pages.

FibroTex; Observation Post; Retrieved from: http://www.fibrotex-tech.com/observation-post; 5 pages.

Coleman's Military Surplus; Support System for Camo Netting; Retrieved from: https://colemans.com/shop/military-tents/support-system-for-camo-netting/; 4 pages.

* cited by examiner

SHAPE DISRUPTER FOR NET SUPPORT SYSTEM

TECHNICAL FIELD

The present disclosure relates to a net support system. More particularly, the present disclosure relates to a shape disrupter for a net support system.

BACKGROUND

The military uses large nets for concealing military objects, such as military equipment, personnel and installations. The large nets may be printed with multi-spectral camouflage and may range anywhere from a few square feet to hundreds of square feet. An exemplary multi-spectral camouflage is Ultra Lightweight Camouflage Net Systems (ULCANS). To install the net systems for concealing objects, a support system is provided. The support system may include shape disrupters, support poles, and stakes. Current support systems may not be compatible with all systems, may produce significant noise signatures, may buckle under normal operating conditions, may be difficult to recover and repack, may produce significant thermal and/or radar signatures, and may be heavy. Current shape disrupters are circular, flat, and not capable of being stacked. The circular, flat shape of the shape disrupters creates a heavy, large shape disrupter that produces high thermal and radar signatures. Thus, a need exists for a support system capable of supporting large nets and having a low thermal signature, a low radar signature, that is lightweight, easily deployed and recovered, and has sufficient wear resistance. A need further exists for a stackable shape disrupter having reduced size, weight, and thermal signature.

BRIEF SUMMARY

According to an embodiment, a shape disrupter for a net system may include an elliptical body having a wall that tapers outwardly from a base portion to an elliptical surface portion; a central portion in an interior space of the elliptical body and extending upward from the base portion, the central portion configured to receive a support pole; a projection in the interior space, the projection configured to interlock the shape disrupter to an adjacent shape disrupter in a stacked condition; and a plurality of protrusions on the elliptical surface portion, the plurality of protrusions configured to grab a net, wherein the elliptical body is formed of a non-conductive, non-metallic material and is configured to be radar transparent.

According to an embodiment, a net support system may include an elliptical shape disrupter configured to support a net, the elliptical shape disrupter comprising a wall that tapers outwardly from a base portion to an elliptical surface portion; a support pole configured to interface with the elliptical shape disrupter; and one or more stakes configured to hold the net to a ground surface, wherein the elliptical shape disrupter, support pole, and one or more stakes are formed of a non-conductive, non-metallic material and are configured to be radar transparent.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION

Accordingly, one embodiment includes a shape disrupter for a net support system. The shape disrupter of the present disclosure may have a conical body and an elliptical shape in plan view. The shape disrupter of the present disclosure may have low thermal signature and low weight. The shape disrupter of the present disclosure may be stackable to reduce the volume occupied by a plurality of shape disrupters when stored as compared to non-stackable shape disrupters. A protrusion on the shape disrupter for fixing each of the shape disrupters in place during stacking may be provided. The shape disrupter of the present disclosure may have cutouts or openings to reduce the weight and thermal signature of the shape disrupter. The shape disrupter of the present disclosure may cooperate with known poles or nets to provide a support system for large nets or screens.

Figure 1:
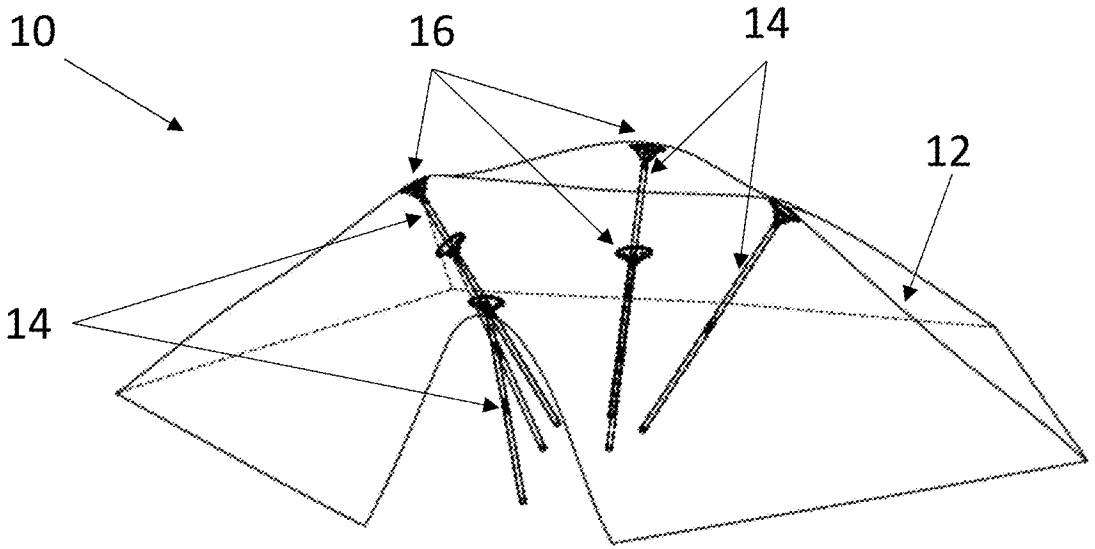
FIG. 1 shows a net having a net support system, according to an embodiment of the present disclosure.

Referring to FIG. 1, a net system 10 is shown. The net system 10 may include a net(s) 12 and a support system. The support system may include one or more support poles 14, one or more shape disrupters 16, and one or more stakes (not shown). The net 12 may be a camouflage net, such as an ultralight camouflage net found in an ULCANS. The net 12 may be a camouflage net such as found in co-pending application Ser. No. 15/690,685, herein incorporated by reference in its entirety. The net 12 may be a large net able to cover large equipment, personnel, and/or building installations (e.g. military installations). The net 12 may be supported on one or more support poles 14 and one or more shape disrupters 16. The net 12 may be staked into the ground surface with one or more stakes (not shown).

Figure 2:
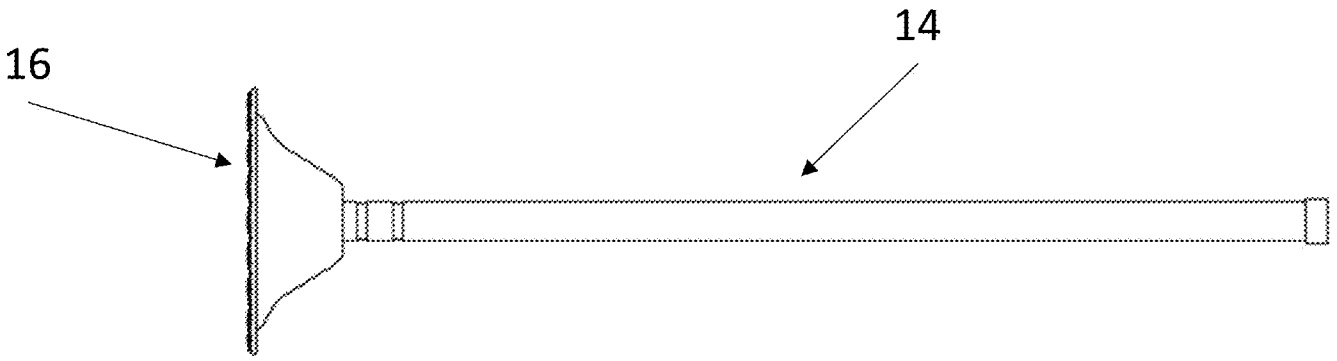
FIG. 2 shows a shape disrupter coupled to a support pole, according to an embodiment of the present disclosure.

Referring to FIG. 2, each of the one or more shape disrupters 16 may be coupled to or may interface with a respective one of the one or more support poles 14. The shape disrupters 16 may be coupled to the support poles 14 with a snap fit, threading, or other coupling type. As shown in FIG. 1, the shape disrupters 16 may be placed adjacent the net 12 to hold the net 12 above the equipment and/or personnel to be covered with the net system 10. The end of the support poles 14 opposite the shape disrupters 16 may be located on the ground surface. Once erected, the net 12 may be staked into place in the ground surface with the one or more stakes (not shown). The stakes may be known stakes or the stakes described in the co-pending U.S. application Ser. No. 16/255,428, herein incorporated by reference in its entirety.

The one or more support poles 14 may be known support poles 14 or may be the support poles described in the co-pending U.S. application Ser. No. 16/255,428, herein incorporated by reference in its entirety. The one or more support poles 14 should not negatively impact the radar signature of the net system 10 when erected. The support poles 14 may be constructed of a bi-stable reeled fiberglass composite or other non-metallic material. The support poles 14 may be aluminum or other material. The support poles 14 may be rollable, collapsible, telescoping, stackable, etc.

Figure 3:
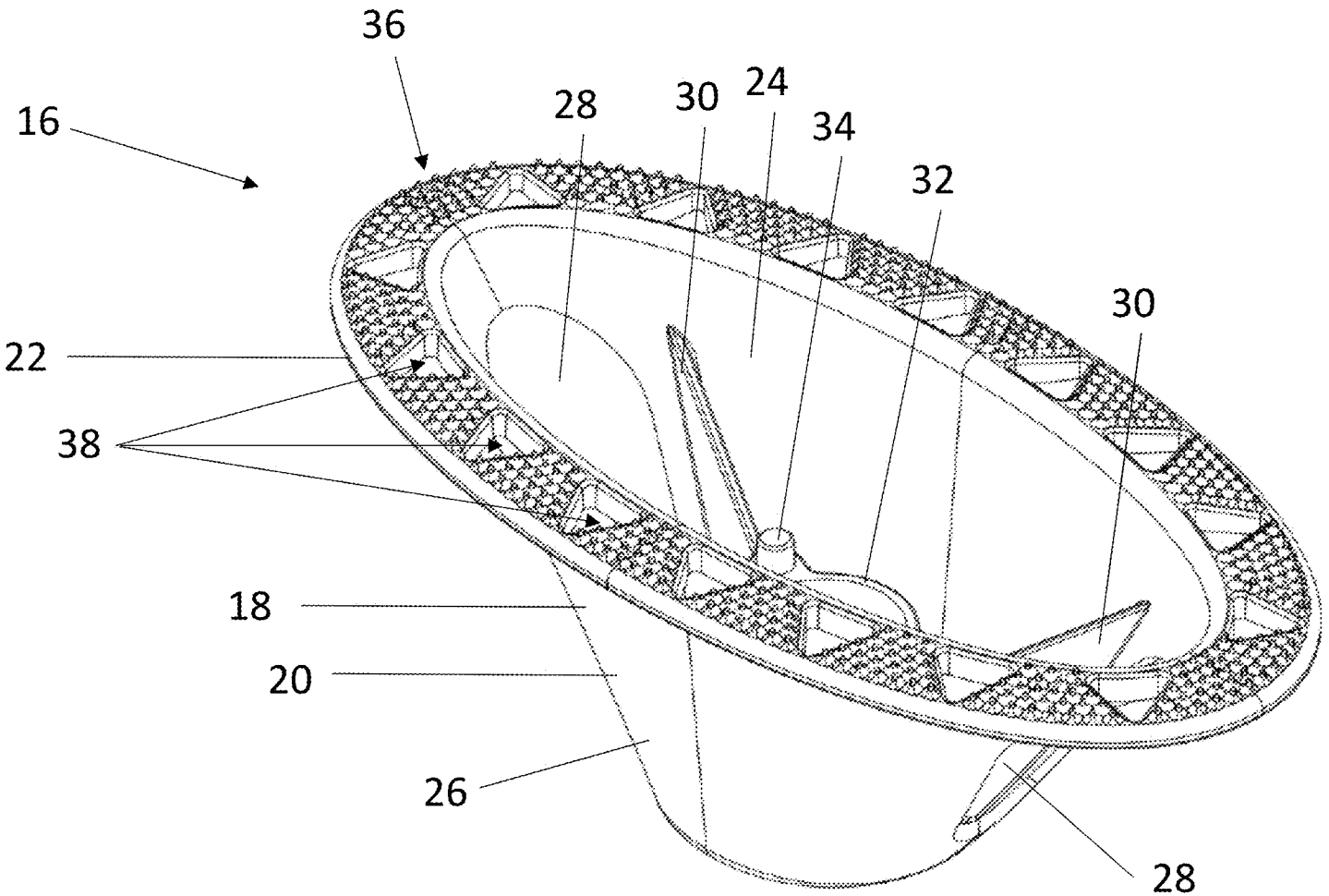
FIG. 3 shows a perspective view of a shape disrupter for a net support system, according to an embodiment of the present disclosure.
Figure 5:
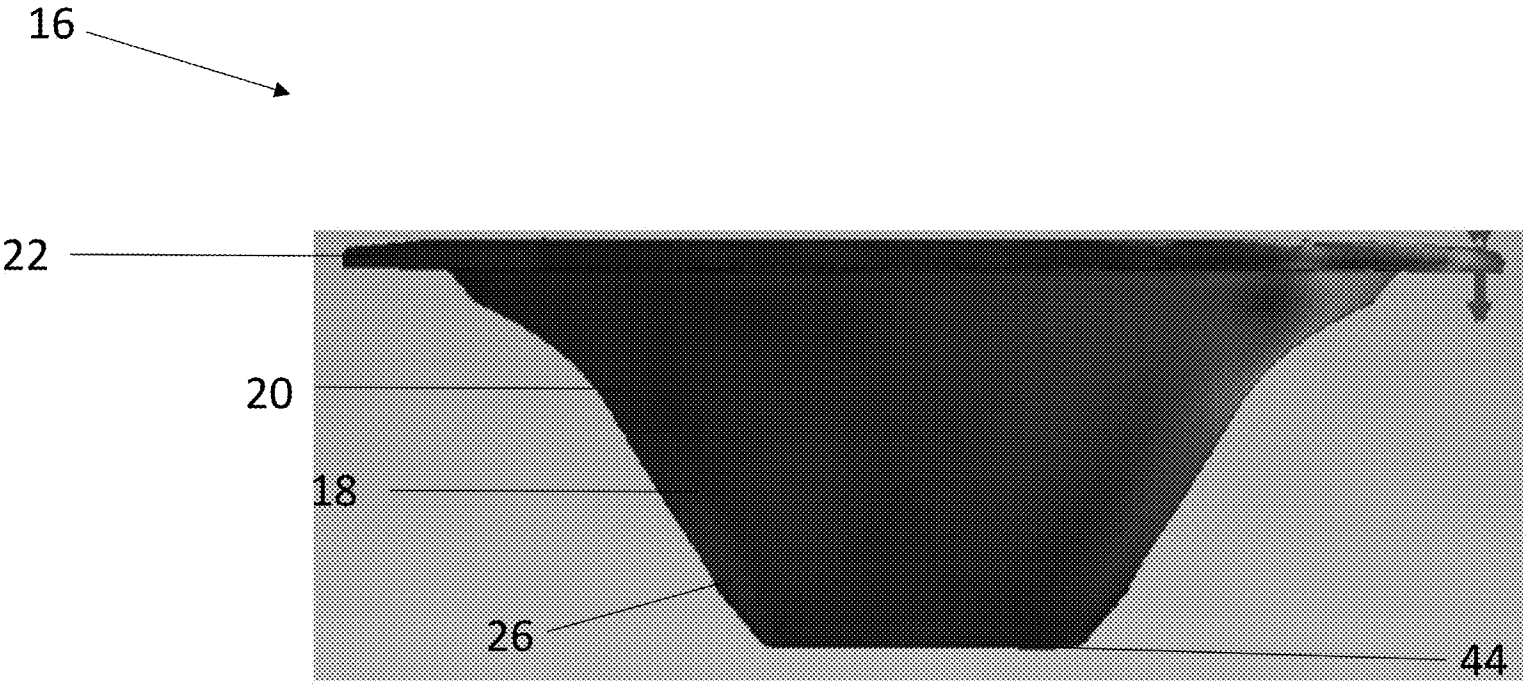
FIG. 5 shows a side view of the shape disrupter of FIG. 2, according to an embodiment of the present disclosure.

FIG. 3 shows a shape disrupter 16 that may be used in the net system 10. The shape disrupter 16 may have a body 18. The body 18 may be a solid body. The body 18 may have an oval or elliptical cone portion 20 and an elliptical surface portion 22. The body 18 may extend between a base portion 44 (FIG. 5) and the elliptical surface portion 22. The body 18 may be conical. That is, the body 18 may taper from the elliptical surface portion 22 to the base portion 44 (FIG. 5). The body 18 may have one or more openings 28 to reduce the material and thus the weight of the body 18. The elliptical cone portion 20 may have an interior surface 24 and an exterior surface 26. The one or more openings 28 may extend through the wall of the elliptical cone portion 20 from the interior surface 24 to the exterior surface 26. The elliptical cone portion 20 may have an interior space located within the interior surface 24. The interior space may be hollow or open. One or more ribs 30 may extend inwardly into the interior space from the interior surface 24. The interior space within the interior surface 24 may include a central portion 32 and one or more projections 34. The one or more projections 34 may extend upward from the central portion 32 or from an area near the central portion 32. The central portion 32 and one or more projections 34 may allow for the shape disrupter 16 to stack with an adjacent shape disrupter 16, as will be discussed in more detail to follow.

With continued reference to FIG. 3, the elliptical surface portion 22 may include nibs or protrusions 36. The protrusions 36 may be distributed about the upper surface of the elliptical surface portion 22. The protrusions 36 may be conical in shape. The protrusions 36 may allow the material of the net 12 (FIG. 1) to grab or attach the shape disrupter 16 and prevent the net 12 from slipping from the shape disrupter 16. More or fewer protrusions 36 may be provided. The protrusions 36 may be shapes other than conical. The protrusions 36 may be uniformly or randomly distributed about the upper surface of the elliptical surface portion 22. The elliptical surface portion 22 may include one or more openings 38. The one or more openings 38 may be triangular cut outs. The one or more openings 38 may reduce the thermal signature of the shape disrupter 16.

Figure 4:
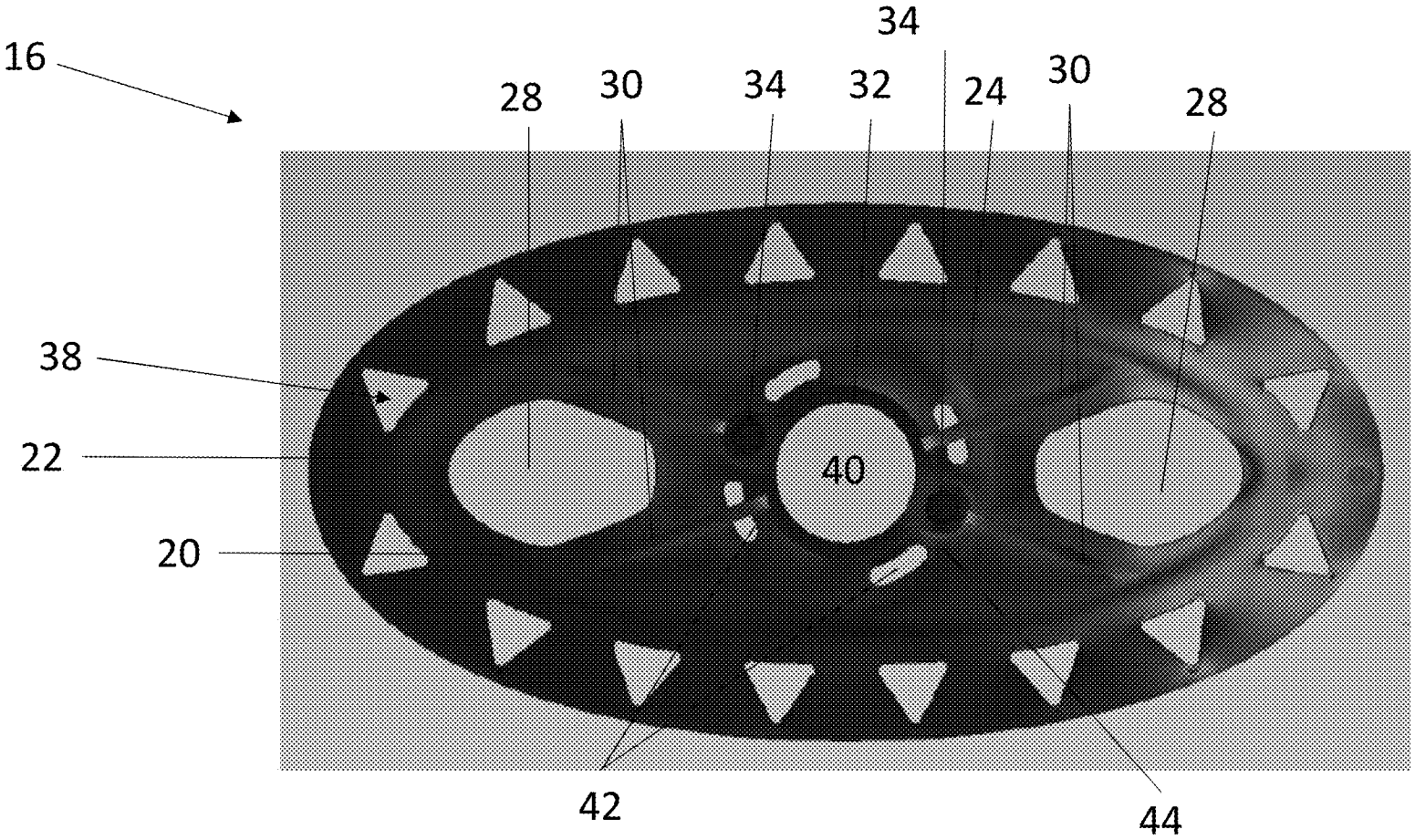
FIG. 4 shows a top view of the shape disrupter of FIG. 2, according to an embodiment of the present disclosure.

FIG. 4 shows a top view of the shape disrupter 16. The central portion 32 may be substantially circular or tubular with a central opening 40 therethrough. The central opening 40 may interface with an end of a support pole 14. The shape disrupter 16 may include one or more openings 42 in a base portion 44 of the elliptical cone portion 20. The shape disrupter 16 may be substantially oval or elliptical in plan view, such as shown in FIG. 4. FIG. 5 shows a side view of the shape disrupter 16. The elliptical cone portion 20 may extend radially outward from the base portion 44 to the elliptical surface portion 22. The exterior surface 26 may be contoured as shown in FIG. 5. The base portion 44 may have a smaller outer diameter than the elliptical surface portion 22. The elliptical surface portion 22 of the shape disrupter 16 may have a diameter along the major axis of about 12 inches and a diameter along the minor axis of about 6 inches, although other dimensions are contemplated.

Figure 6:
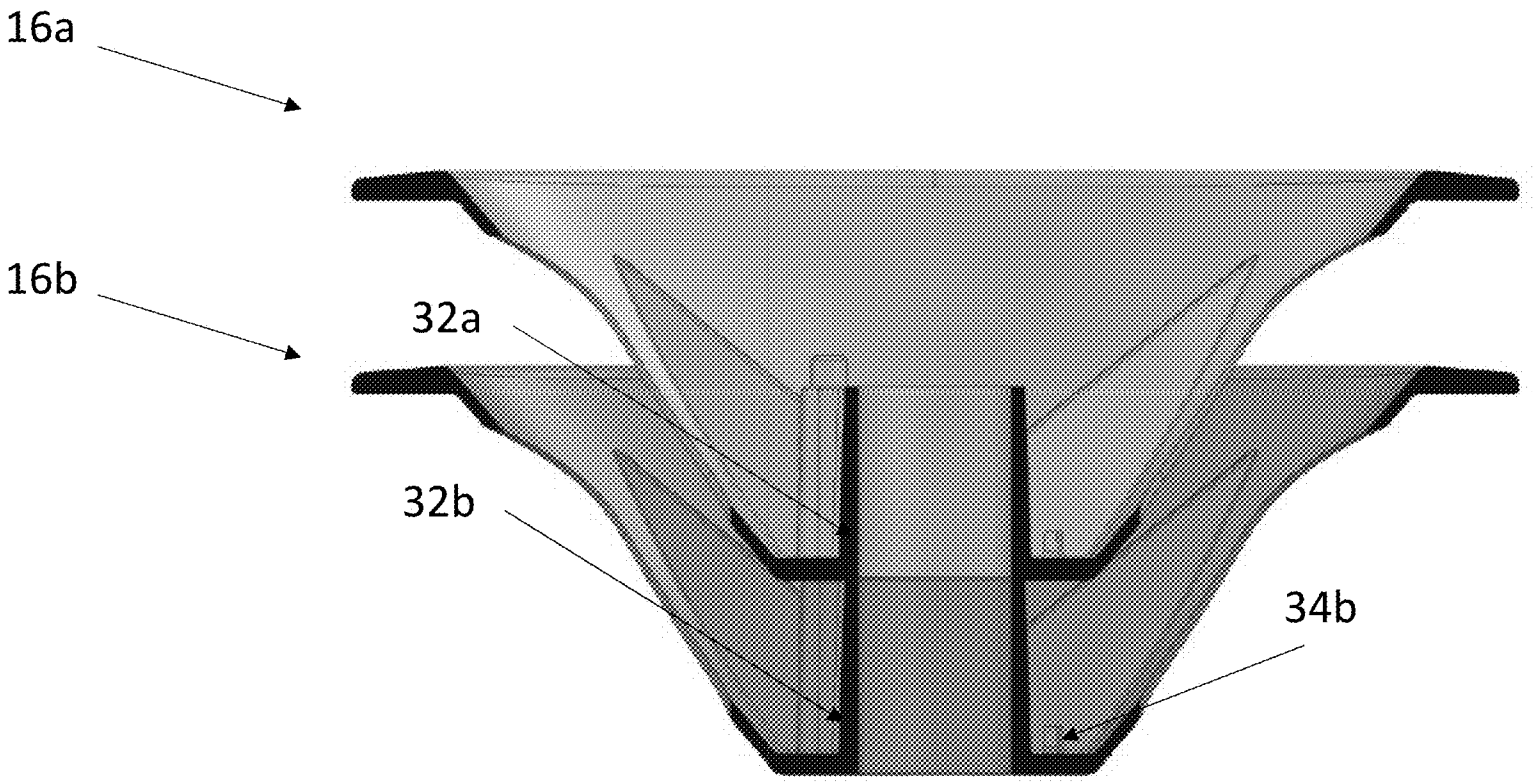
FIG. 6 shows a plurality of shape disrupters in a stacked condition, according to an embodiment of the present disclosure.

FIG. 6 shows an upper shape disrupter **16*a* and a lower shape disrupter 16*b* of the shape disrupters 16 stacked for storage. The central portion 32*a* of the upper shape disrupter 16*a* may be seated on top of the central portion 32*b* of the lower shape disrupter 16*b*. One or more openings (not visible) in the upper shape disrupter 16*a* may receive the one or more projections 34*b* of the lower shape disrupter 16*b*. This arrangement may interlock or hold together the upper shape disrupter 16*a* and lower shape disrupter 16*b*. Additional shape disrupters may be stacked above upper shape disrupter 16*a* and/or below lower shape disrupter 16*b*. The stacking of shape disrupters 16 may reduce the volume required for the support system when stored in a storage case. For example, the space needed for six shape disrupters 16 may be about 0.47 cubic feet as compared to about 1.47 cubic feet for conventional (e.g. flat, circular with a center mount) shape disrupters. The reduced volume of the stored shape disrupters 16** may allow for easier carrying and repacking during deployment and recovery by personnel.

Figure 7:
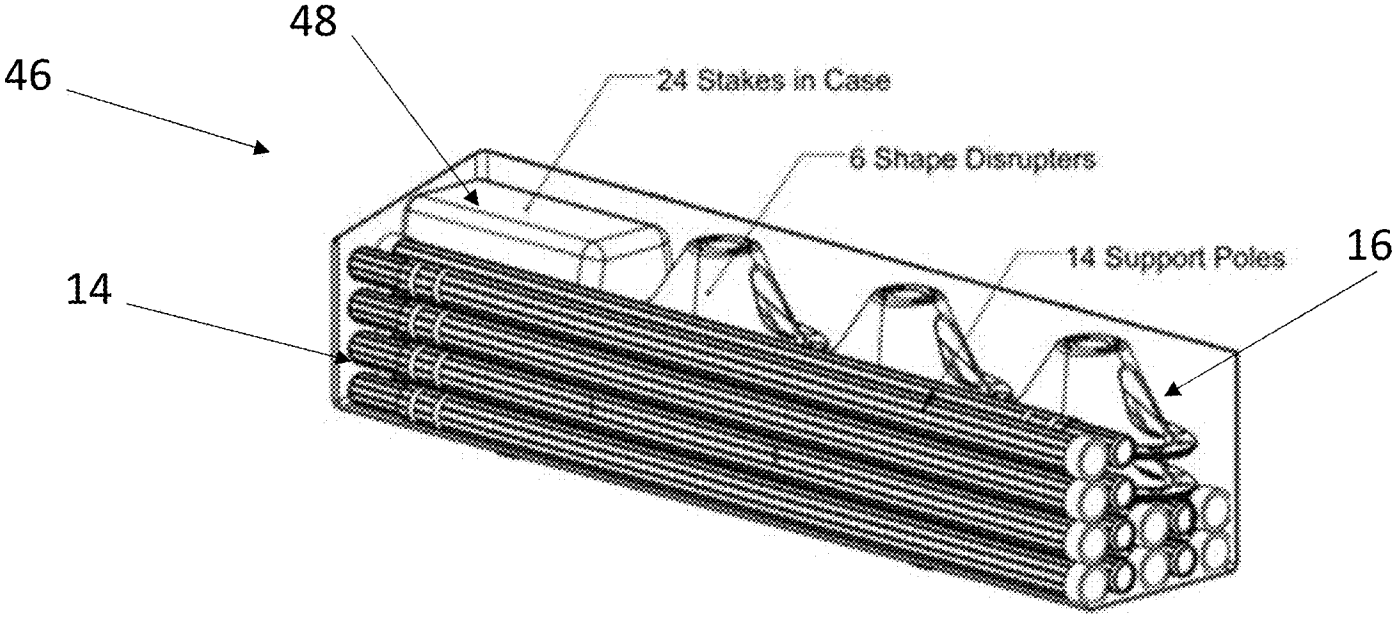
FIG. 7 shows a net support system in a packed condition, according to an embodiment of the present disclosure.

When the support system is not in use to hold a net 12 (FIG. 1), the support system may be stored in a storage case 46 such as shown in FIG. 7. The storage case 46 may hold the one or more support poles 14, the one or more shape disrupters 16, and a case 48 for holding the one or more stakes. The storage case 46 may a hold a plurality of each of the components of the support system such that one or more nets 12 (FIG. 1) may be erected from the components of the storage case 46. For example, the storage case 46 may hold 14 support poles 14, 6 shape disrupters 16, and 24 stakes (not shown). Although other numbers of components are contemplated. The support system may have a volume of less than 3.57 cubic feet when stored in the storage case 46. The support system may have a volume of about 2.70 cubic feet when stored in the storage case 46.

The support system (e.g. support poles 14, shape disrupter 16, and stakes) of the present disclosure may be stowed in its own package (e.g. storage case 46). The components of the support system may be matte black in color, or any other matte color, to limit the amount of glint, glare, and gloss produced by the support system. The support system may be interchangeable between all classes and types of nets and may be compatible with conventional nets, such as existing ULCANS. The support system may be radar transparent, non-metallic, and may not negatively affect the overall signature of the erected ULCANS or the items being concealed or camouflaged.

The one or more shape disrupters 16 may be sized such that sufficient surface area is provided to support the weight of the net and to disrupt the shape of the net at the point where the shape disrupter 16 is located when deployed. Each of the one or more shape disrupters 16 may be capable of supporting a 20 lbf of force on the edge of the elliptical surface portion 22. The displacement of the edge of the elliptical surface portion 22 under 20 lbf of force may be from about 0.91 mm to about 1.31 mm. The shape disrupters 16 may not be permanently deformed during use. The shape disrupters 16 may be compatible with conventional nets and/or support poles.

The one or more shape disrupters 16 should not degrade the multispectral concealment performance of the net system 10 being supported. The one or more shape disrupters 16 may provide an aggressive or tight grip on the net 12 to prevent the support poles 14 from falling when billowing of the net 12 occurs in gusty conditions. During normal operating conditions, the one or more shape disrupters 16 should not cause adverse wear or damage to the surface of the net 12 coupled to the one or more shape disrupters 16. The one or more shape disrupters 16 may have a toughness or wear resistance that prevents or limits the damage caused when dropping the shape disrupters from a height of about 10 feet onto a hard surface.

Each of the one or more shape disrupters 16 may have a reduced size, reduced weight, and/or reduced thermal signature as compared to conventional shape disrupters (e.g. flat, circular shape disrupters with a center mount and without a conical body and/or oval shape). The shape disrupter 16 of the present disclosure may have a reduced overall thermal signature and improved packability as compared to the conventional shape disrupters. The shape disrupter 16 may be about 32% smaller than the conventional shape disrupters. Wherever a shape disrupter 16 is placed in the net system 10 (see FIG. 1) there is an opportunity for the thermal or radar signal to be disrupted, causing the concealed object(s) to potentially be seen. The shape disrupter 16 may reduce the thermal signature by about 80% as compared to the conventional shape disrupters. Thus, the thermal or radar signal produced by the shape disrupter 16 may reduce the opportunities for the concealed objects to be detected, as compared to the conventional shape disrupters.

In an exemplary embodiment, each shape disrupter 16 may weigh about 0.66 lbs, may have a surface area of about 14 square inches, and may be non-conductive. In an exemplary embodiment, the support system of the present disclosure may have a heat retention of 128 degrees for 60 minutes of thermal loading. The plurality of cut outs present in the shape disrupter 16 may assist in reducing the weight and thermal signature.

The shape, including the tapered body and cutouts or openings, of the shape disrupter 16 may lead to an overall reduced footprint and thus reduced interference with the thermal or radar signal as compared to conventional shape disrupters. The non-conductive and/or non-metallic material of the shape disrupter 16 may reduce the thermal or radar signal. For example, as compared to a conventional shape disrupter, the shape disrupter 16 may occupy a smaller space under the net 12 and may be made of a material less susceptible to radar detection, such as a non-conductive, non-metallic material. When a radar scan approaches the net 12, the shape disrupter 16 may not disrupt the signature of the net 12 or may disrupt the signature of the net 12 to a smaller degree than a conventional shape disrupter due to the shape and material.

Figure 8:
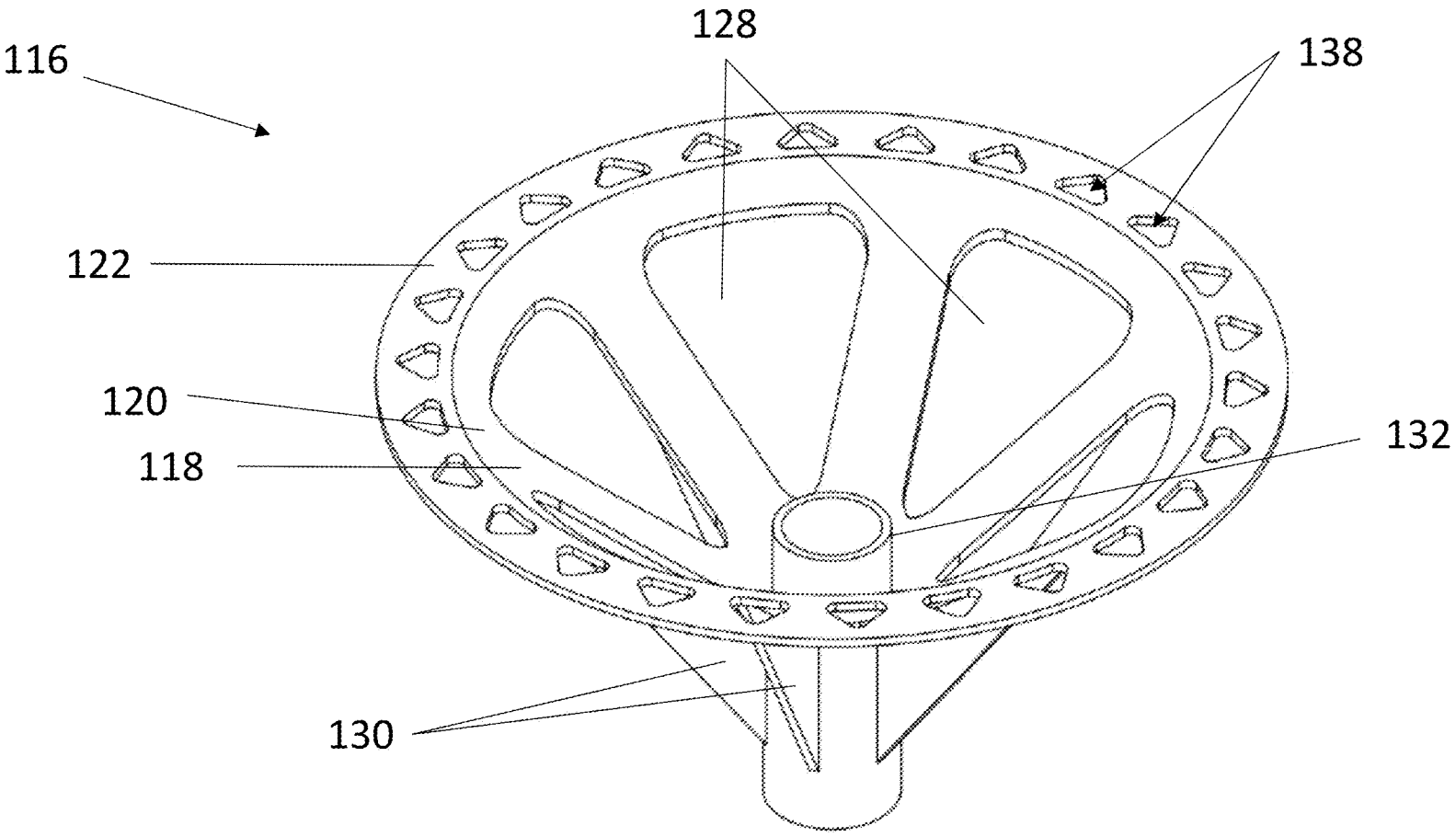
FIG. 8 shows an alternate shape disrupter, according to an embodiment of the present disclosure.

Referring to FIG. 8, an alternative shape disrupter 116 is shown. The shape disrupter 116 may be used in the net system 10 and/or the storage case 46 as previously described. The shape disrupter 116 may have a body 118. The body 118 may have a cone portion 120 and a circular surface portion 122. One or more openings 128 may extend through the wall of the cone portion 120. The cone portion 120 may have one or more ribs 130 extending outwardly from the exterior surface of the cone portion 120. The cone portion 120 may include a central portion 132 that may allow for the shape disrupter 116 to stack with an adjacent shape disrupter 116, as discussed with respect to shape disrupter 16.

Although not depicted, the circular surface portion 122 may include nibs or protrusions, such as protrusions 36. The circular surface portion 122 may include one or more openings 138. The one or more openings 138 may be triangular cut outs. The one or more openings 138 may reduce the thermal signature of the shape disrupter 116. The central portion 132 may be substantially circular or tubular with a central opening therethrough. The shape disrupter 116 may be substantially circular in plan view. The cone portion 120 may extend radially outward from a base portion adjacent the central portion 132 to the circular surface portion 122. The base portion may have a smaller outer diameter than the circular surface portion 122.

The shape disrupter 116 may have a reduced thermal signature as compared to conventional shape disrupters. The shape disrupter 116 may have an area reduction of about 62% as compared to conventional shape disrupters.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A shape disrupter for a net system, the shape disrupter comprising:

an elliptical body having a wall that tapers outwardly from a base portion to an elliptical surface portion;

a central portion in an interior space of the elliptical body and extending upward from the base portion, the central portion configured to receive a support pole;

a projection in the interior space, the projection configured to interlock the shape disrupter to an adjacent shape disrupter in a stacked condition; and a plurality of protrusions on the elliptical surface portion, the plurality of protrusions configured to grab a net, wherein the elliptical body is formed of a non-conductive, non-metallic material and is configured to be radar transparent.

2. The shape disrupter of claim 1, wherein the elliptical body comprises an opening configured to reduce a weight of the elliptical body.

3. The shape disrupter of claim 2, wherein the opening comprises a first plurality of openings in the elliptical surface portion and a second plurality of openings in the wall.

4. The shape disrupter of claim 1, wherein the elliptical body is substantially elliptical in plan view.

5. The shape disrupter of claim 1, wherein the elliptical body is configured to not negatively affect an overall thermal signature of the net system.

6. The shape disrupter of claim 1, wherein the elliptical body has a surface area of about 14 square inches.

7. The shape disrupter of claim 1, wherein the elliptical body has a weight of about 0.66 lbs.

8. A net support system comprising:

an elliptical shape disrupter configured to support a net, the elliptical shape disrupter comprising a wall that tapers outwardly from a base portion to an elliptical surface portion;

a support pole configured to interface with the elliptical shape disrupter; and one or more stakes configured to hold the net to a ground surface, wherein the elliptical shape disrupter, support pole, and one or more stakes are formed of a non-conductive, non-metallic material and are configured to be radar transparent.

9. The net support system of claim 8, further comprising a plurality of elliptical shape disrupters, a plurality of support poles, and a plurality of stakes, wherein the plurality of elliptical shape disrupters are stackable with one another.

10. The net support system of claim 9, wherein each of the plurality of elliptical shape disrupters comprise a central portion and a projection, the central portion configured to receive the support pole and the projection configured to interlock with an adjacent elliptical shape disrupter.

11. The net support system of claim 9, wherein each of the plurality of elliptical shape disrupters includes an interior space within the wall and wherein each of the plurality of elliptical shape disrupters is configured to be received within the interior space of an adjacent elliptical shape disrupter.

12. The net support system of claim 9, further comprising a storage case for storing the plurality of elliptical shape disrupters, the plurality of support poles, and the plurality of stakes.

13. The net support system of claim 12, wherein the storage case is rolled for storage.

14. The net support system of claim 9, wherein, in a stored condition, the plurality of elliptical shape disrupters, the plurality of support poles, and the plurality of stakes has a volume of about 2.7 cubic feet.

* * * * *